United States Patent [19]

Lehrman

[11] Patent Number: 4,773,585

[45] Date of Patent: Sep. 27, 1988

[54] LAUNDRY BAG

[76] Inventor: David Lehrman, 207 Barclay Cir., Cheltenham, Pa. 19012

[21] Appl. No.: 846,432

[22] Filed: Mar. 31, 1986

[51] Int. Cl.[4] ..... B65D 91/00

[52] U.S. Cl. ..... 232/1 B; 248/99; 383/23

[58] Field of Search ..... 232/1 B, 43.1; 383/906, 383/121, 13, 23, 33, 38, 75, 73, 67; 248/99

[56] References Cited

U.S. PATENT DOCUMENTS

| | | | |
|---|---|---|---|
| 605,343 | 6/1898 | Ross . | |
| 1,183,500 | 5/1916 | Smith | 383/23 X |
| 1,184,876 | 5/1916 | Rike | 383/23 X |
| 1,216,015 | 2/1917 | Tichenor . | |
| 1,224,568 | 5/1917 | Ream . | |
| 1,512,421 | 10/1924 | Harrison | 248/99 |
| 2,625,973 | 1/1953 | Weldon | 150/1 |
| 2,647,550 | 8/1953 | Cannon | 383/23 X |
| 2,704,098 | 3/1955 | Pocock | 383/23 |
| 2,740,445 | 6/1953 | Fornell | 150/1 |
| 3,850,367 | 11/1974 | Fortriede | 232/1 B |

*Primary Examiner*—Robert W. Gibson, Jr.
*Attorney, Agent, or Firm*—Seidel, Gonda, Goldhammer & Abbott

[57] ABSTRACT

A combined laundry bag and clothes hamper in which a bag is suspended from a removable hanger which frames the bag opening, the bag being internally partitioned to allow segregation of clothes and being provided at its bottom with a zipper to permit ready removal of soiled laundry from the hamper bag. The hamper bag can be removed from the hanger, and has a drawcord to permit closure of its top to facilitate its being used to carry soiled laundry to a laundramat, washing machine or other cleaning facility.

3 Claims, 2 Drawing Sheets

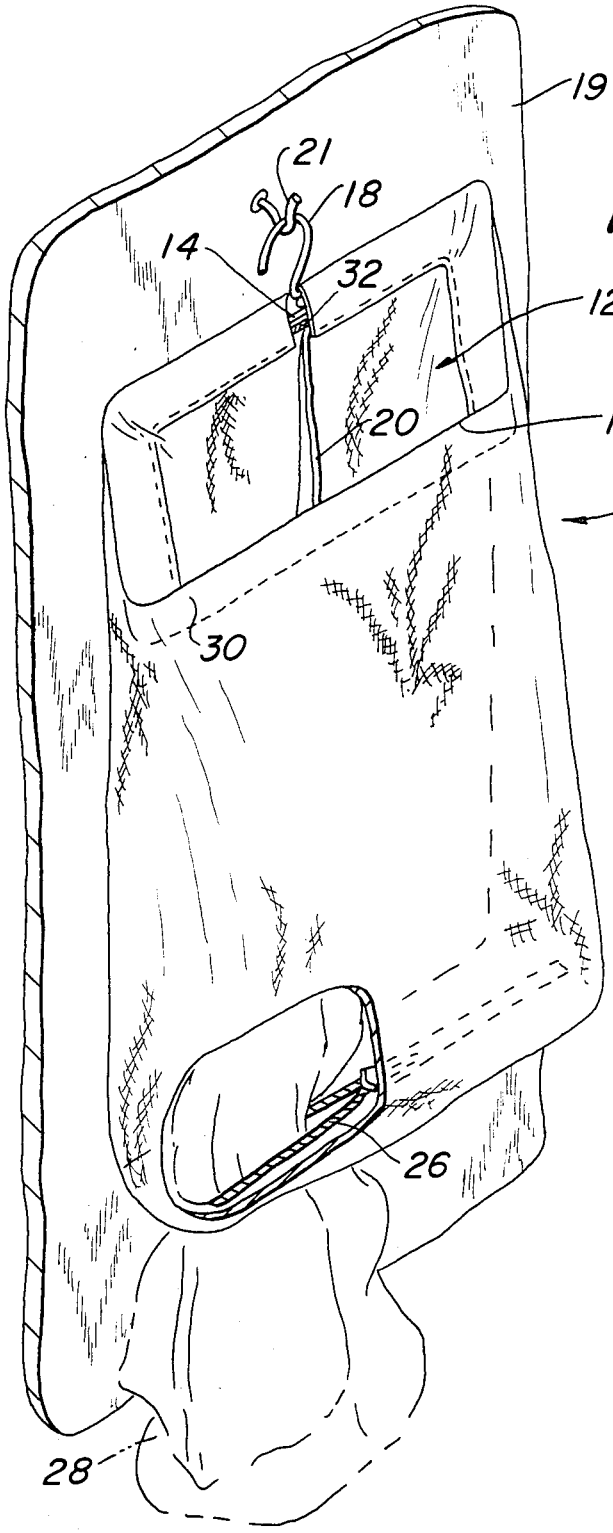
FIG. 1
FIG. 5
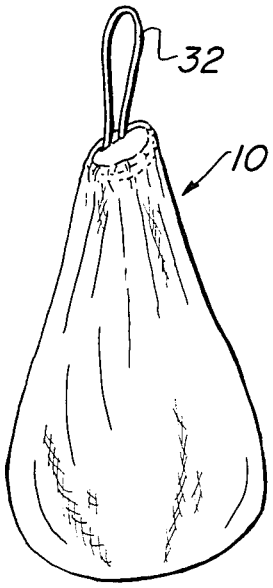

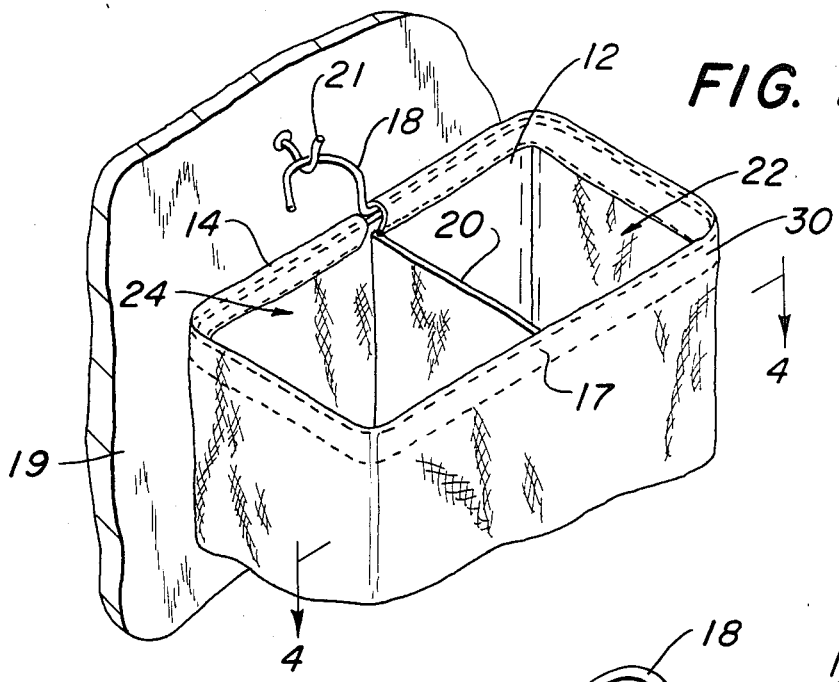
FIG. 2
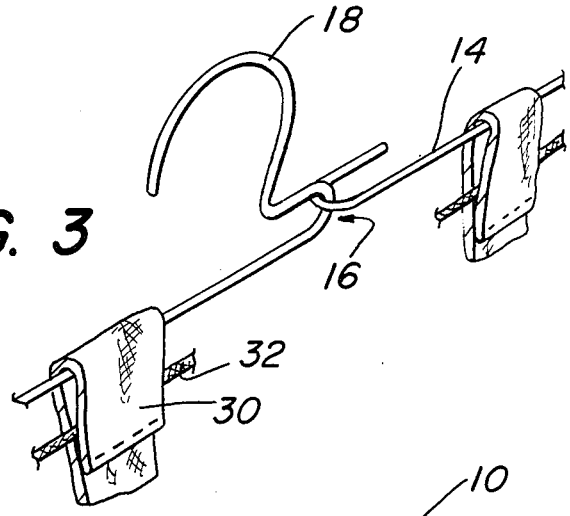
FIG. 3
FIG. 4
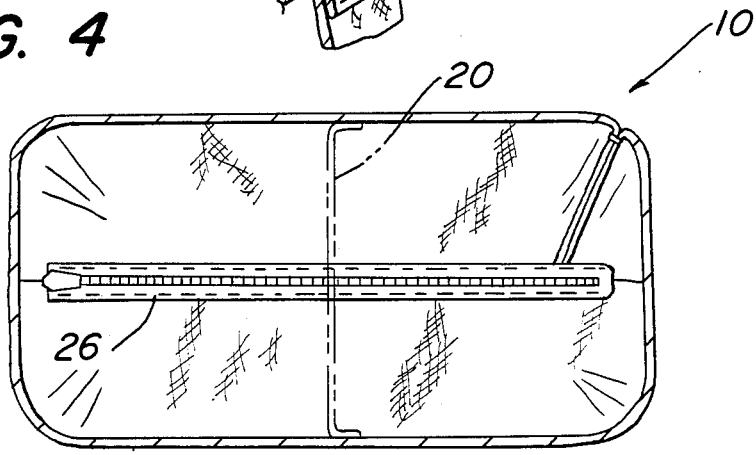

LAUNDRY BAG

BACKGROUND OF THE INVENTION

The conventional practice in handling soiled laundry is to place the laundry in a clothes hamper or laundry bag until a sufficient amount of laundry has accumulated to constitute a full load for a washing machine. The soiled laundry is then removed from the hamper or bag, sorted in accordance with the color and type of fabric involved, and then washed. If the soiled laundry is to be transported to a laundramat or some other remote point for washing; the laundry, in the case of a clothes hamper, is removed from the hamper and placed in a laundry bag for ease of carrying. The laundry bag is normally provided with a drawcord at the top opening to permit its closure. When the washing location is reached, the laundry is removed from the bag, sorted and washed. The procedure outlined above is both inefficient and time consuming and results in excessive and repetitive handling of the soiled laundry. The present invention is designed to alleviate this problem by providing a combination laundry bag and clothes hamper which permits convenient one-time storage and sorting of the soiled laundry, and facilitates its transport to the wash area when a sufficient quantity of laundry has accumulated.

SUMMARY OF THE INVENTION

The present invention consists of the provision of a combination laundry bag and clothes hamper in which the open end of the bag is fitted with a frame made of wire, plastic or other suitable material. The frame is provided with a loop or hook enabling it to be conveniently hung from a closet rod, hook or other device. The framed opening, which is typically rectangular in configuration, and of a convenient size such for example, as an opening measuring 15½" (39.37 cm) x 7¼" (18.42 cm) permits ready access to the bag and easy insertion of the soiled laundry without the bother of unbunching the top of a conventional laundry bag after it has been drawn closed by the drawcord as a result of its being hung on a doorknob or hook. The frame, which comprises an essential element of the invention, can be uncoupled, as seen in FIG. 3, to permit removal of the bag for laundrying or for separate use. The hem, casing or loops through which the frame is inserted may also include a drawcord so that the user may exercise the option of using the bag like a standard laundry bag for transport of soiled laundry to the laundry room, laundramat or other desired location.

To facilitate removal of soiled laundry from the bag the closed end of the bag is provided with a zipper enabling the user to retrieve all or any portion of the soiled laundry without reaching into the bag. To permit presorting of the clothes as to type, color or fabric, the bag may be provided with internal partitions which enable initial and onetime sorting of the laundry. Removal of the laundry in accordance with its presorted location can be easily accommodated by partial opening of the zipper beneath the desired partition. The bag can be made of cotton, synthetic, combination blends or plastics, but in the preferred embodiment, hereinafter described, the inventor has selected 70 denier nylon fabric as the desired material.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 1 is a perspective showing of a preferred embodiment of the invention with the bag in a collapsed condition and with a front section removed to show details of the zipper construction.

FIG. 2 is a partial view of the top of the bag showing the frame construction and partition.

FIG. 3 is a detail of the frame.

FIG. 4 is a cross-sectional view of the bag showing the zipper and partitioning means; and FIG. 5 depicts the bag with the frame removed.

DETAILED DESCRIPTION OF THE INVENTION

Referring to the drawings wherein like numerals indicate like elements, there is shown in FIG. 1 a perspective of the combination laundry bag and clothes hamper comprising the present invention. The bag is shown in its resting or collapsed condition.

The hamper bag 10, is provided at its open top portion 12, see FIG. 2, with a frame 14, preferably made of 3/16 inch diameter chrome plated wire or any other material of suitable rigidity and strength. As best seen in FIG. 3, the frame is provided with a coupling 16 such that when the frame is compressed from the sides as seen in FIG. 2, the frame can be uncoupled to permit removal of the bag from the frame. Any form of coupling can be used, the illustrated arrangement being simply one form of desired construction. When the user wishes to place soiled laundry in the bag, the front edge 17 of the bag is simply grasped and the frame 14 pivoted about the hook or loop 18. This action results in automatic opening of the top of the bag and provides a readily accessible framed opening for easy insertion of laundry within the bag. By orienting the hook or hinge 18 in the plane of the frame 14, the top of bag, as seen in FIG. 1, lies relatively flat against the supporting structure 19, the mouth of the opening 12 being only slightly ajar. The degree of opening can be adjusted by varying the angle of the hook 18 relative to the plane of the frame. For example, if it were desired to have the plane of the frame form roughly a 90° angle with the plane of the supporting structure, the hook could be rigidly affixed to the frame at a 90° angle so that the back of the frame, and hanger hook reacting against the support hook 21, hold the bag top in the open position.

One or more partitions 20 may also be provided within the bag extending from top to bottom, as seen in FIGS. 2 and 4. The partition forms individual compartments 22 and 24 into which laundry can be segregated as to color, type or fabric. A zipper 26 is provided at the bottom of the bag to permit easy removal of the soiled laundry 28, as shown in FIG. 1, without the need of inverting or reaching into the bag. A single zipper extending across the length of the bag may be used, as illustrated, or a series of individual zippers communicating with individual compartments may be used. This latter arrangement is desirable when using more than one partion so as to permit withdrawal from selected compartments, as for example, the middle compartment without disturbing the laundry in adjacent compartments. To permit the hamper bag to be used as a standard laundry bag, it may have inserted within the casing 30, along with the frame 14, a drawcord 32. When the hamper bag is removed from the frame, as seen in FIG. 5, it can be used to transport the soiled laundry to the laundramat, laundry room or other location, much the same as with a conventional bag.

The present invention may be embodied in other specific forms without departing from the spirit or essential attributes thereof, and, accordingly, reference should be made to the appended claims, rather than to the foregoing specification, as indicating the scope of the invention.

I claim:

1. In a combination laundry bag and clothes hamper which receives soiled laundry, the improvement comprising: a bag having an opened top portion and a closed bottom portion; a frame beng removable from said open top of said bag, being adapted to be hung from a support structure, and being movable with respect to said support structure between a first and second position, whereby said frame and said bag are generally at said first position and said opened top portion being substantially closed at said first position and when said frame and said bag are moved to said second position, said opened top portion being opened to receive said soiled laundry; means permitting easy opening and closing of said bottom portion located at said bottom portion of said bag; means providing internal partitioning of said bag to permit segregation of laundry within the bag; and said bag having a casing located adjacent said opened top portion and a draw cord disposed within said casing so that when said frame is removed from said opened top of said bag the bag can be used as a conventional laundry bag.

2. The combination laundry bag and clothes hamper in accordance with claim 1, wherein said means for permitting easy opening and closing comprises a zipper.

3. The combination laundry bag and clothes hamper in accordance with claim 1 in which said frame includes means for decoupling said frame to permit removal of said frame from the bag.

* * * * *